US007309119B2

(12) United States Patent
Kojima

(10) Patent No.: US 7,309,119 B2
(45) Date of Patent: Dec. 18, 2007

(54) INK-JET RECORDING APPARATUS

(75) Inventor: Masatomo Kojima, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 11/639,613

(22) Filed: Dec. 15, 2006

(65) Prior Publication Data

US 2007/0139485 A1 Jun. 21, 2007

(30) Foreign Application Priority Data

Dec. 15, 2005 (JP) ..... 2005-361925

(51) Int. Cl.
*B41J 2/21* (2006.01)

(52) U.S. Cl. ..... 347/43; 347/65

(58) Field of Classification Search ..... 347/15, 347/40, 43, 65, 68, 10, 11
See application file for complete search history.

(56) References Cited

U.S. PATENT DOCUMENTS 6,502,927 B2 * 1/2003 Nozawa ..... 347/65
2001/0015734 A1 * 8/2001 Kanda et al. ..... 347/15
2006/0268058 A1 * 11/2006 Muraoka ..... 347/40

FOREIGN PATENT DOCUMENTS

JP 6305134 11/1994
JP 2001-315324 11/2001

* cited by examiner

*Primary Examiner*—Lamson Nguyen
(74) *Attorney, Agent, or Firm*—Reed Smith LLP

(57) ABSTRACT

In an ink-jet recording apparatus, an active portion for jetting a pigment ink has an area greater than an area of an active portion for jetting a dye ink. Accordingly, the active portion for jetting the pigment ink is capable of generating energy greater than that generated by the active portion for jetting the dye ink. In addition, since a diameter of nozzles which jet the pigment ink is greater than that of nozzles which jet the dye ink, it is possible to jet, at a substantially same speed, the pigment ink and the dye ink to which the different energies are imparted. Further, when performing the recording with the pigment ink, a liquid-droplet having a large volume can be obtained, and when performing the recording with the dye ink, a liquid-droplet having a small volume can be obtained.

15 Claims, 9 Drawing Sheets

INK-JET RECORDING APPARATUS

CROSS-REFERENCE TO RELATED APPLICATION

The present application claims priority from Japanese Patent Application No. 2005-361925, filed on Dec. 15, 2005, the disclosure of which is incorporated herein by reference in its entirety.

BACKGROUND OF THE INVENTION

1. Field of the Invention

The present invention relates to an ink-jet recording apparatus which includes a first nozzle group which jets a pigment ink, and a second nozzle group which jets a dye ink.

2. Description of the Related Art

In general, a pigment ink blurs or spreads on a surface of a paper to an extent smaller than a dye ink does. Accordingly, in a conventional ink-jet recording apparatus, when images are recorded with same resolution with the pigment ink and the dye ink respectively, then the pigment ink is jetted such that a volume of a droplet (droplet-volume) of the pigment ink jetted for forming one dot is greater than a droplet-volume of the dye ink jetted for forming one dot. For example, in an ink-jet recording apparatus as described in Japanese Patent Application Laid-open Publication No. 2001-315324, a number of driving waveforms used for jetting the pigment ink is different from a number of driving waveforms used for jetting the dye ink, so that a number of liquid droplets of the pigment ink jetted for forming one dot is greater than a number of liquid droplets of the dye ink for forming one dot.

However, in a method hitherto known in which the volume of the liquid droplet of ink (ink-droplet volume) is changed by changing a number of driving waveforms, there is a limit on the ink-droplet volume which can be controlled. Therefore, there is a problem that it is not possible to meet the demand for further improving recording speed and recording quality. For example, for performing a high-contrast, high-quality recording, there is known an ink-jet recording apparatus in which a pigment ink is used as a black ink, and a dye ink is used as a color ink other than the black ink. Here, when recording a solid-color area (one-color area, area in which recording is performed without a gap or space), with the method for changing the liquid-droplet volume by changing the number of driving waveforms, the number of driving waveforms required for forming one dot with the black ink is greater than the number of driving waveforms for forming one dot with the color ink. For outputting a large number of driving waveforms in a driving cycle, it is necessary to make the driving cycle to be long or prolonged, which in turn makes a recording time to be long. Further, in a high-resolution recording, it is required that the liquid-droplet volume to be further smaller. However, there is a difficulty such that a diameter of a dot, formed with the dye ink used as the color ink, easily spreads on a paper surface to an extent greater than a diameter of a dot formed with the pigment ink used as the black ink, thereby making it hard to achieve a high-quality printing.

SUMMARY OF THE INVENTION

A first object of the present invention is to realize an ink-jet recording apparatus which is capable of further increasing the recording speed by the pigment ink. A second object of the present invention is to realize an ink-jet recording apparatus which is capable of further improving the recording quality by the dye ink. It should be noted that parenthesized reference numerals and symbols assigned to elements respectively shown below are merely examples of the elements and are not intended to limit the elements.

According to a first aspect of the present invention, there is provided an ink-jet recording apparatus (1) which performs recording by jetting a pigment ink and a dye ink, the apparatus including:

- a first nozzle group (39*a*) which jets the pigment ink;
- a second nozzle group (39*b*, 39*c*, and 39*d*) which jets the dye ink;
- a first pressure chamber group (31*a*) which is provided corresponding to the first nozzle group (39*a*);
- a second pressure chamber group (31*b*, 31*c*, and 31*d*) which is provided corresponding to the second nozzle group (39*b*, 39*c*, and 39*d*);
- a first active portion group (41) which applies a jetting pressure, to the pigment ink in the first pressure chamber group (31*a*), by a piezoelectric effect; and
- a second active portion group (42, 43, and 44) which applies the jetting pressure, to the dye ink in the second pressure chamber group (31*b*, 31*c*, and 31*d*), by the piezoelectric effect;
- wherein a diameter (ϕ1) of nozzles belonging to the first nozzle group (39*a*) is greater than a diameter (ϕ2) of nozzles belonging to the second nozzle group (39*b*, 39*c*, and 39*d*);
- an active portion, belonging to the first active portion group (41), which faces a pressure chamber belonging to the first pressure chamber group (31*a*) has an area (S1) greater than an area (S2) of an active portion, belonging to the second active portion group (42, 43, and 44), which faces a pressure chamber belonging to the second pressure chamber group (31*b*, 31*c*, and 31*d*).

In the ink-jet recording apparatus (1) of the present invention, the active portion, belonging to the first active portion group (41), which faces the pressure chamber belonging to the first pressure chamber group (31*a*) has the area (S1) greater than the area (S2) of the active portion, belonging to the second active portion group (42, 43, and 44), which faces the pressure chamber belonging to the second pressure chamber group (31*b*, 31*c*, and 31*d*). Accordingly, even when a same voltage is applied to the first active portion group (41) and the second active portion group (42, 43, and 44), it is possible to generate, in the active portion belonging to the first active portion group (41), energy greater than an energy generated in the active portion belonging to the second active portion group (42, 43, and 44). In other words, in a case of performing the recording with the pigment ink, it is possible to achieve a liquid droplet having a volume greater than in a case of performing the recording with the dye ink. Consequently, there is no need to have the number of driving waveforms at the time of forming one dot with the black ink greater than the number of driving waveforms at the time of forming one dot with the color ink. Accordingly, it is possible to shorten a cycle for forming one dot of the black ink (one black-ink dot), and to increase a recording speed by the pigment ink. Furthermore, since the diameter (ϕ1) of the nozzles belonging to the first nozzle group (39*a*) is greater than the diameter (ϕ2) of the nozzles belonging to the second nozzle group (39*b*, 39*c*, and 39*d*), it is possible to jet, at a substantially same speed, a liquid droplet of the pigment ink and a liquid droplet of the dye ink to which the different energies are imparted respectively. Consequently, it is possible to land the liquid droplet at a desired position, and to perform the recording with a high recording quality. Further, since it is possible to make the droplet-volume of the dye ink to be small, it is possible to realize a high quality recording by the dye ink.

In the ink-jet recording apparatus (1) of the present invention, the diameter (ϕ1) of the nozzles belonging to the first nozzle group (39*a*) may be 20 μm; and the diameter (ϕ2) of the nozzles belonging to the second nozzle group (39*b*, 39*c*, and 39*d*) may be 17 μm.

In the ink-jet recording apparatus (1) of the present invention, an electrostatic capacitance (C1) of the active portion belonging to the first active portion group (41) may be greater than an electrostatic capacitance (C2) of the active portion belonging to the second active portion group (42, 43, and 44). Specifically, the electrostatic capacitance (C1) of the active portion belonging to the first active portion group (41) may be 1500 pF; and the electrostatic capacitance (C2) of the active portion belonging to the second active portion group (42, 43, and 44) may be 1000 pF. In an ink-jet recording apparatus of a type in which a jetting pressure is applied to the ink in the pressure chamber by using the piezoelectric effect, there is a characteristic that when the electrostatic capacitance of the active portion is increased (becomes substantial), then the energy is increased (becomes substantial) and a volume of the ink droplet is increased. Consequently, by making the electrostatic capacitance (C1) of the active portion belonging to the first active portion group (41) to be greater than the electrostatic capacitance (C2) of the active portion belonging to the second active portion group (42, 43, and 44), when performing the recording by the pigment ink, liquid droplets (ink droplets) having a large volume can be obtained; and when performing the recording by the dye ink, liquid droplets (ink droplets) having a small volume can be obtained. Accordingly, it is possible to increase the recording speed with the pigment ink, and to have a high quality recording with the dye ink.

In the ink-jet recording apparatus (1) of the present invention, one of a rising time and a falling time (T1) of a driving waveform for generating the piezoelectric effect in the active portion belonging to the first active portion group (41) may be longer than one of a rising time and a falling time (T2) of a driving waveform for generating the piezoelectric effect in the active portion belonging to the second active portion group (42, 43, and 44). Specifically, one of the rising time and the falling time (T1) of the driving waveform for generating the piezoelectric effect in the active portion belonging to the first active portion group (41) may be 1.5 μs; and one of the rising time and the falling time (T2) of the driving waveform for generating the piezoelectric effect in the active portion belonging to the second active portion group (42, 43, and 44) may be 1.0 μs. In the ink-jet recording apparatus of the type in which the jetting pressure is applied to the ink in the pressure chamber by using the piezoelectric effect, there is a characteristic that when a length of the rising time or the falling time of the driving waveform becomes long, the volume of the ink droplet is increased. Consequently, by making the rising time or the falling time (T1) of the driving waveform, for generating the piezoelectric effect in the active portion for jetting the pigment ink, to be longer than the rising time or the falling time (T2) of the driving waveform for generating the piezoelectric effect in the active portion for jetting the dye ink, then in a case of the pigment ink, liquid droplets (ink droplets) having a large volume can be obtained, and in a case of dye ink, liquid droplets (ink droplets) having a small volume can be obtained. Accordingly, it is possible to increase the recording speed with the pigment ink, and to have a high quality recording with the dye ink.

In the ink-jet recording apparatus (1) of the present invention, the diameter (ϕ1) of the nozzles belonging to the first nozzle group and the diameter (ϕ2) of the nozzles belonging to the second nozzle group may be selected so that a jetting speed of the pigment ink is same as a jetting speed of the dye ink.

In the ink-jet recording apparatus (1) of the present invention, the pigment ink may be a black ink, and the dye ink may be a color ink. In this case, since it is possible to obtain a liquid-droplet of the black ink having a large volume, it is possible to record, at a high speed, a recording area such as a solid-black color area in which the black ink is used in a large amount. Further, by performing the recording by overlapping droplets, of color ink or inks, having a small liquid-droplet volume, it is possible to freely obtain a dot of a small diameter or a dot of a large diameter, thereby making it is possible to perform a recording of color image or the like with high quality.

According to a second aspect of the present invention, there is provided an ink-jet recording apparatus (1) which performs recording by jetting a pigment ink and a dye ink, the apparatus including:

a first nozzle group (39*a*) which jets the pigment ink;

a second nozzle group (39*b*, 39*c*, and 39*d*) which jets the dye ink;

a first pressure chamber group (31*a*) which is provided corresponding to the first nozzle group (39*a*);

a second pressure chamber group (31*b*, 31*c*, and 31*d*) which is provided corresponding to the second nozzle group (39*b*, 39*c*, and 39*d*);

a first active portion group (41) which applies a jetting pressure, to the pigment ink in the first pressure chamber group (31*a*), by a piezoelectric effect; and a second active portion group (42, 43, and 44) which applies the jetting pressure, to the dye ink in the second pressure chamber group (31*b*, 31*c*, and 31*d*), by the piezoelectric effect;

wherein a diameter (ϕ1) of nozzles belonging to the first nozzle group (39*a*) is greater than a diameter (+2) of nozzles belonging to the second nozzle group (39*b*, 39*c*, and 39*d*);

an active portion, belonging to the first active portion group (41), which faces a pressure chamber belonging to the first pressure chamber group (31*a*) has an area (S1) greater than an area (S2) of an active portion, belonging to the second active portion group (42, 43, and 44), which faces a pressure chamber belonging to the second pressure chamber group (31*b*, 31*c*, and 31*d*);

one of a rising time and a falling time (T1) of a driving waveform for generating the piezoelectric effect in the active portion belonging to the first active portion group (41) is longer than one of a rising time and a falling time (T2) of a driving waveform for generating the piezoelectric effect in the active portion belonging to the second active portion group (42, 43, and 44); and a ratio (C1/C2) of an electrostatic capacitance (C1) of the active portion belonging to the first active portion group (41) to an electrostatic capacitance (C2) of the active portion belonging to the second active portion group (42, 43, and 44) is same as a ratio (T1/T2) of one of the rising time and the falling time (T1) of the driving waveform for generating the piezoelectric effect in the active portion belonging to the first active portion group (41) to one of the rising time and the falling time (T2) of the driving waveform for generating the piezoelectric effect in the active portion belonging to the second active portion group (42, 43, and 44).

In the ink-jet recording apparatus (1) of the present invention, the area (S1) of the active portion, belonging to the first active portion group (41), which faces the pressure chamber belonging to the first pressure chamber group (31*a*) is greater than the area (S2) of the active portion, belonging to the second active portion group (42, 43, and 44), which faces the pressure chamber belonging to the second pressure chamber group (31*b*, 31*c*, and 31*d*). Accordingly, even when a same voltage is applied to the first active portion group (41) and the second active portion group (42, 43, and 44), it is possible to generate an energy, in the active portion belonging to the first active portion group (41), which is greater than an energy generated in the active portion belonging to the second active portion group (42, 43, and 44). Consequently, in a case of performing a recording by the pigment ink, liquid droplets (ink droplets) having a large volume can be obtained; and in a case of performing a recording by the dye ink, liquid droplets (ink droplets) having a small volume of can be obtained. Further, since the diameter (ϕ1) of the nozzles belonging to the first nozzle group (39*a*) connecting to (communicating with) the first pressure chamber group (31*a*) is greater than the diameter (ϕ2) of the nozzles belonging to the second nozzle group (39*b*, 39*c*, and 39*d*) communicating with the second pressure chamber group (31*b*, 31*c*, and 31*d*), it is possible to jet, at nearly a same speed, a droplet of the pigment ink and a droplet of the dye ink to which the different energies are imparted respectively. Consequently, it is possible to land the liquid droplet at a desired position, and to perform the recording with a high recording quality. In an ink-jet recording apparatus of a type in which the jetting pressure is applied to the ink in the pressure chamber by using the piezoelectric effect, there is a characteristic that when a length of the rising time or the falling time of the driving waveform becomes long, the volume of the ink droplet is increased. Further, the rising time or the falling time of the driving waveform is proportional to a product of the electrostatic capacitance of the active portion and an internal resistance value of a driving circuit which supplies the driving waveform to the active portion. Therefore, by making the ratio (C1/C2) of the electrostatic capacitance (C1) of the active portion which jets the pigment ink to the electrostatic capacitance (C2) of the active portion which jets the dye ink to be same as (equal to) the ratio (T1/T2) of one of the rising time and the falling time (T1) of the driving waveform for generating the piezoelectric effect in the active portion which jets the pigment ink to one of the rising time and the falling time (T2) of the driving waveform for generating the piezoelectric effect in the active portion which jets the dye ink, it is possible to make the internal resistance value of the driving circuits, which supply the driving waveform to the both active portions respectively, to be same among the both active portions. Accordingly, the driving circuit can be designed easily. In addition, a quality control of the driving circuit is not complicated, and it is possible to reduce the manufacturing cost of the ink-jet recording apparatus.

In the ink-jet recording apparatus (1) of the present invention, the diameter (ϕ1) of the nozzles belonging to the first nozzle group (39*a*) may be 20 μm; and the diameter (ϕ2) of the nozzles belonging to the second nozzle group (39*b*, 39*c*, and 39*d*) may be 17 μm.

In the ink-jet recording apparatus (1) of the present invention, one of the rising time and the falling time (T1) of the driving waveform for generating the piezoelectric effect in the active portion belonging to the first active portion group (41) may be 1.5 μs; and one of the rising time and the falling time (T2) of the driving waveform for generating the piezoelectric effect in the active portion belonging to the second active portion group (42, 43, and 44) may be 1.0 μs.

In the ink-jet recording apparatus (1) of the present invention, a ratio of an electrostatic capacitance (C1) of the active portion belonging to the first active portion group (41) to an electrostatic capacitance (C2) of the active portion belonging to the second active portion group (42, 43, and 44) may be 1.5.

In the ink-jet recording apparatus (1) of the present invention, a circuit resistance of an output circuit which drives the active portion belonging to the first active portion group (41) may be same as a circuit resistance of an output circuit which drives the active portion belonging to the second active portion group (42, 43, and 44). In this case, it is easy to design a driver IC (80) which drives the first active portion group (41) and the second active portion group (42, 43, and 44), and a quality control of the driver IC (80) also becomes easy.

DETAILED DESCRIPTION OF THE PREFERRED EMBODIMENTS

Figure 1:
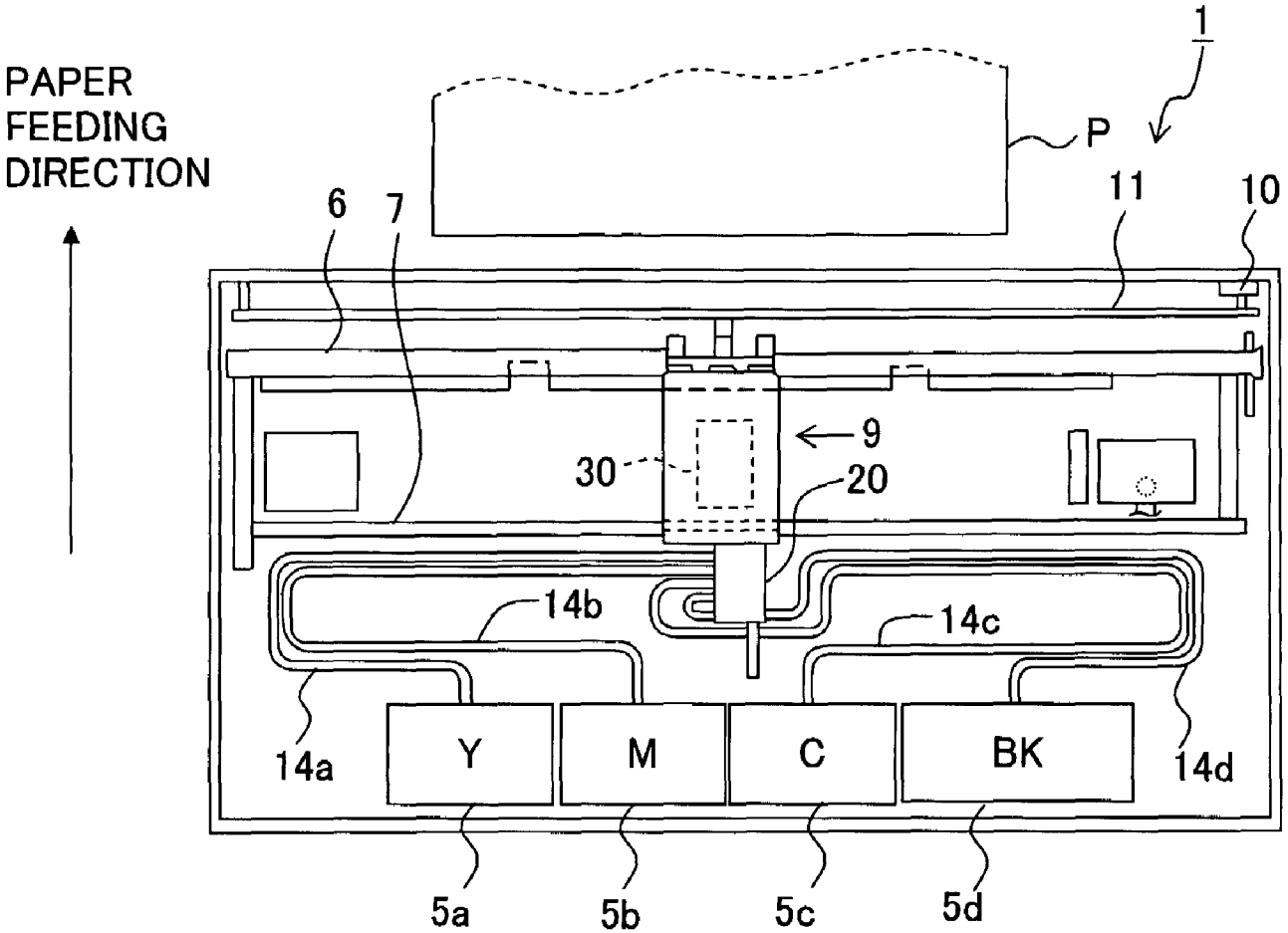
FIG. 1 is a plan view showing a main structure of an ink-jet recording apparatus.

An embodiment of the present invention will be explained below with reference to the accompanying diagrams. As shown in FIG. 1, an ink-jet recording apparatus 1 has two guide shafts 6 and 7 provided therein. A head holder 9 which serves also as a carriage is attached to the guide shafts 6 and 7. A head unit 30, which performs recording by jetting an ink onto a recording paper P, is held by the head holder 9. The head holder 9 is attached to an endless belt 11, which is rotated by a carriage motor 10, and the head holder 9 moves along the guide shafts 6 and 7 by the drive of the carriage motor 10.

Further, the ink-jet recording apparatus 1 includes an ink tank 5*a* which contains a yellow ink, an ink tank 5*b* which accommodates a magenta ink, an ink tank 5*c* which accommodates a cyan ink, and an ink tank 5*d* which accommodates a black ink. The ink tanks 5*a*, 5*b*, 5*c*, and 5*d* are connected to flexible ink supply tubes 14*a*, 14*b*, 14*c*, and 14*d* respectively. The inks supplied by the ink supply tubes respectively are introduced into the head unit 30 via a tube joint 20 which is extended from the head holder 9 in a paper feeding direction. In this embodiment, the black ink is a pigment ink, and each of the color inks other than the black ink is a dye ink.

Next, a structure of the head unit 30 will be explained with reference to FIGS. 2 to 5. In the following explanation, a direction in which the ink is jetted is referred to as a downward direction.

Figure 2:
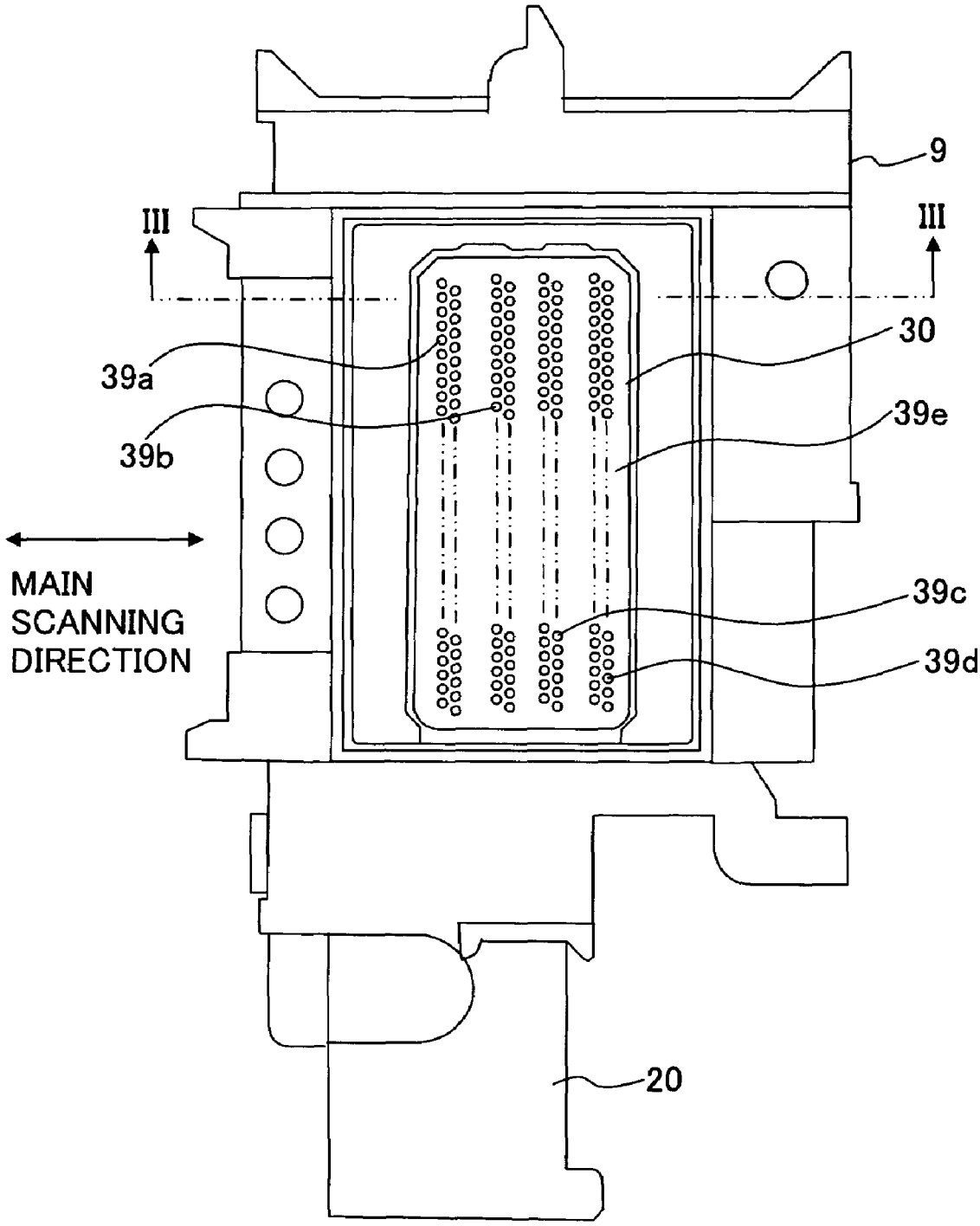
FIG. 2 is a plan view of a head holder as viewed from a nozzle surface.

As shown in FIG. 2, a group of nozzles 39*a* (first nozzle group) which jet the black ink are arranged in a nozzle surface 39*e* formed in the lower surface of the head unit 30, in two rows in a direction orthogonal to a direction of movement (main scanning direction) of the head holder 9; and in the nozzle surface 39*e*, a nozzle group (second nozzle group), including nozzles 39*b* which jet the yellow ink and are arranged in two rows, nozzles 39*c* which jet the cyan ink and are arranged in two rows, and nozzles 39*d* which jet the magenta ink and are arranged in two rows in the main scanning direction. Each of the nozzles 39*a* to 39*d* is opened downwardly to face the upper surface of the recording paper P (see FIG. 1), is formed.

Figure 5A:
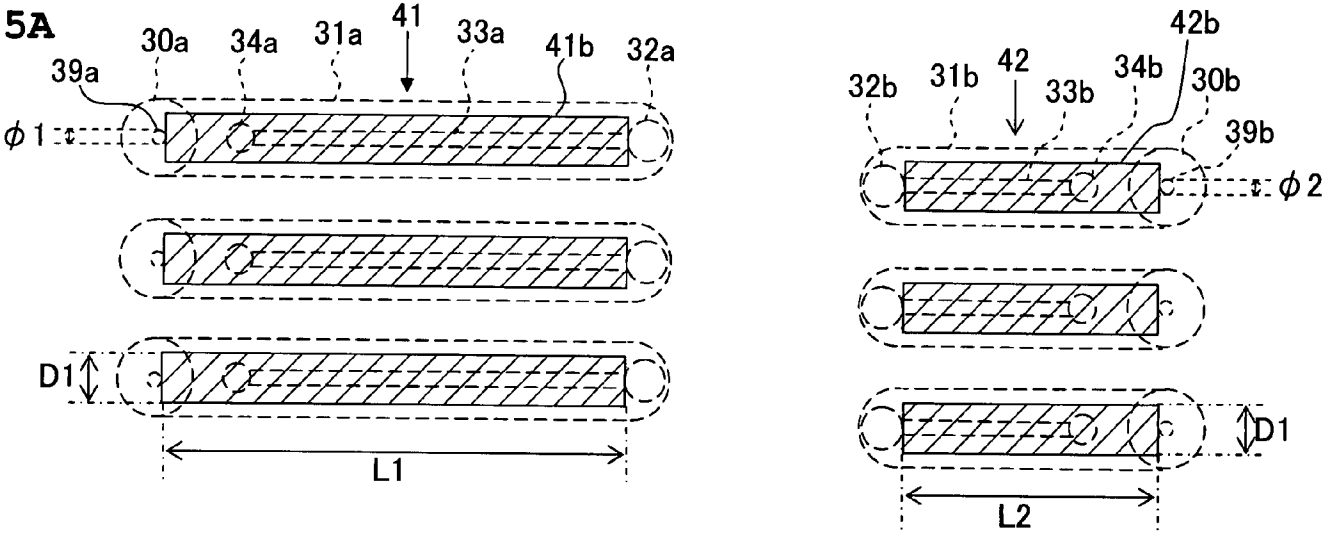
FIG. 5A is plan view showing active portion of the head unit shown in FIG. 3.
Figure 5B:
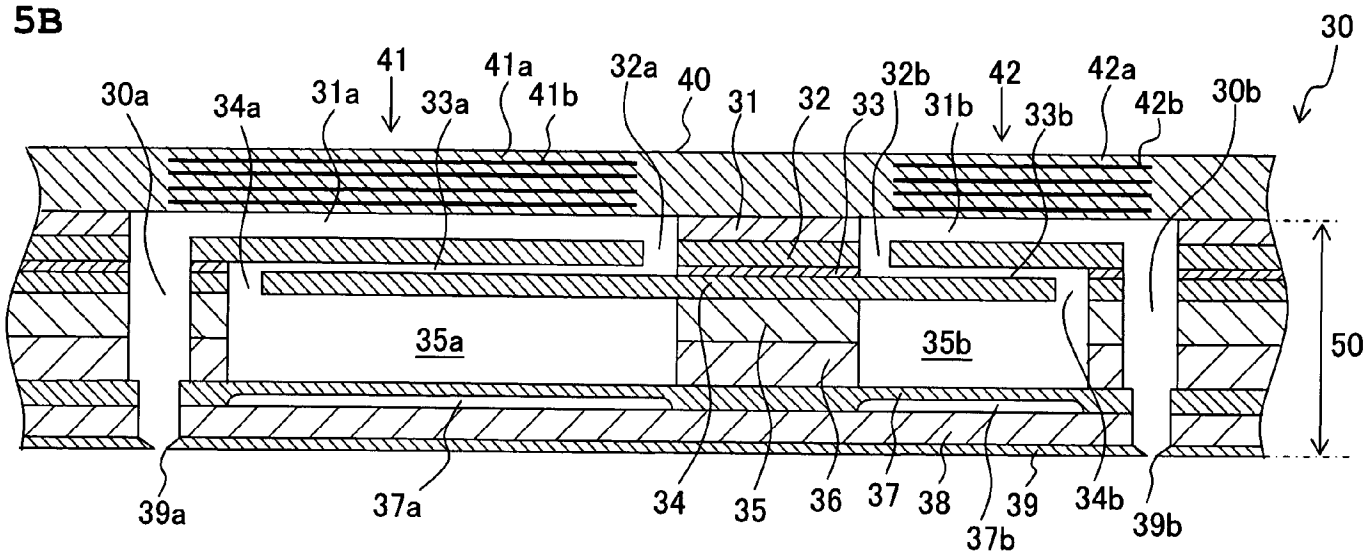
FIG. 5B is a partially enlarged cross-sectional view of the head unit shown in FIG. 3.

As shown in FIG. 5B, the head unit 30 is formed by joining a piezoelectric actuator 40 to the upper surface of a cavity unit 50. The cavity unit 50 has a structure in which total of nine thin plates are overlapped and joined together in an order, from below, of a nozzle plate 39, a spacer plate 38, a damper plate 37, manifold plates 36 and 35, a spacer plate 34, a supply plate 33, a base plate 32, and a cavity plate 31. Each of the plates are joined one another with an adhesive or the like, and the cavity unit 50 and the piezoelectric actuator 40 are also joined with an adhesive or the like.

Figure 3:
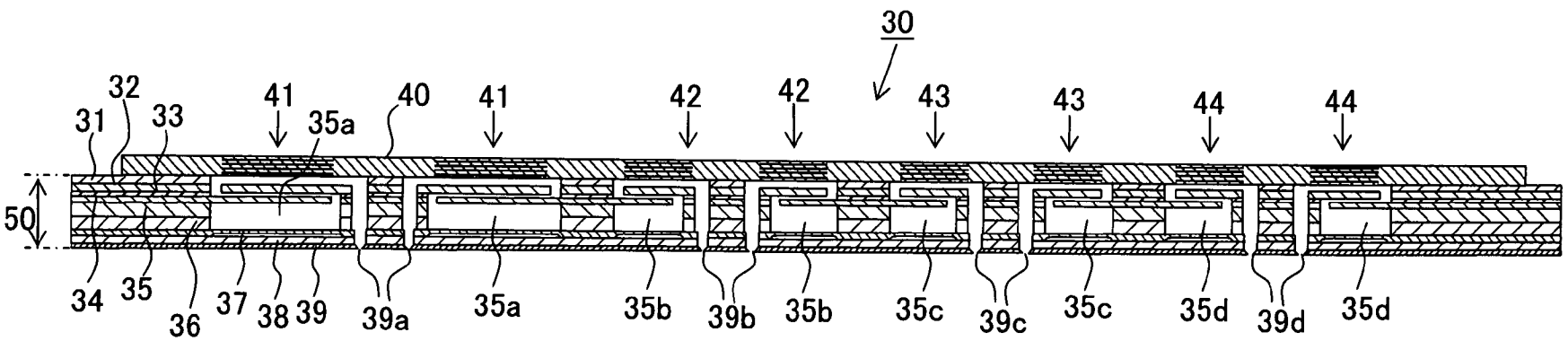
FIG. 3 is an enlarged cross-sectional view of a head unit held by the head holder shown in FIG. 2, as indicated by arrows A-A.

As shown in FIG. 3, the piezoelectric actuator 40 includes a group of active portions 41 (first active portion group) which generate energy for jetting the black ink; and active portions 42 which generate energy for jetting the yellow ink, active portions 43 which generate energy for jetting the cyan ink, and a group of active portions 44 (second active portion group) which generate energy for jetting the magenta ink. Here, the term "active portion" means a portion which acts (functions) for applying a jetting pressure to the ink in a pressure chamber which is arranged under or below each of the active portions.

The piezoelectric actuator 40 is formed by stacking alternately piezoelectric sheets formed of a piezoelectric material and electrodes in the form of a film. As shown in FIG. 5B, each of the active portions 41 is formed by a portion 41*a* of the piezoelectric sheets sandwiched between electrodes 41*b* from above and below. Each of the active portions 42 is formed by a portion 42*a* of the piezoelectric sheet sandwiched between the electrodes 42*b* from above and below. The active portions 43 and 44 are also formed similarly. In each of the active portions 41, 42, 43, and 44, provided that a length in a longitudinal direction of a portion thereof facing a pressure chamber positioned under the active portion is an active length (active-portion length), then as shown in FIG. 5A, an active length L1 (length in a longitudinal direction) of the active portion 41 which jets the black ink is set to be greater (longer) than an active length L2 of the active portion 42 which jets the yellow ink. Further, length of each of the active portions 41 and 42 in a short direction is set to be a same value of D1. Although not shown in the diagram, an active length of each of the active portions 43 and 44 is same as the active length L2 of the active portion 42, and a length in the short direction (width) of each of the active portion 43 and 44 is D1. In other words, an area S1 of the active portion 41 which jets the black ink is greater than an area S2 of each of the active portions 42, 43, and 44 which jet the inks other than the black ink respectively. In this case, when a same voltage is applied to the active portion 41 which jets the black ink, and to the active portions 42, 43, and 44 which jet the inks other than the black ink, it is possible to generate energy for jetting in the active portion 41 greater than energy generated in the other active portions 42, 43, and 44. Consequently, in a case of performing the recording with the black ink, a liquid droplet (ink droplet) having a substantial (greater) volume can be obtained; and in a case of performing the recording with the color ink, a liquid droplet (ink droplet) having a small volume can be obtained, thereby making it possible to increase the recording speed by the black ink, and to realize a high quality recording by the color ink.

Further, a portion, of each of the active portions, which is made of the piezoelectric material, has a positive characteristic in which an electrostatic capacitance is increased as an area of an electrode is increased. Therefore, an electrostatic capacitance C1 of the portion, of the active portion 41, which is made of the piezoelectric material, is greater than an electric capacitance C2 of a portion, of each of the other active portions 42, 43, and 44. Consequently, when a same driving waveform is applied to the electrodes corresponding to the active portion 41 to 44 respectively, the active portion 41 is capable of generating an energy for jetting the ink which is greater than the energy generated by the active portions 42, 43, and 44. Consequently, in the case of performing the recording with the black ink, a liquid droplet (ink droplet) having a great volume can be obtained; and in the case of performing the recording with the color ink, a liquid droplet (ink droplet) having a small volume can be obtained. Accordingly, it is possible to increase the recording speed by the black ink, and to realize a high quality recording by the color ink.

In this embodiment, the active length L1 of the active portion 41 is 1.2 mm; the active length L2 of each of the active portions 42, 43, and 44 is 0.8 mm; and the width D1 of each of the active portions 41, 42, 43, and 44 is 0.16 mm. In other words, the area S1 of the active portion 41 is S1=L1×D1=1.2 mm×0.16 mm=0.192 $mm^2$; and the area S2 of each of the active portions 42, 43, and 44 is S2=L2×D1=0.8 mm×0.16 mm=0.128 $mm^2$. Further, the electrostatic capacitance C1 of the portion, of the active portion 41, made of the piezoelectric layer is 1500 pF; and the electrostatic capacitance C2 of the portion, of each of the active portions 42, 43, and 44, which is made of the piezoelectric layer is 1000 pF.

A common ink chamber is formed at a position which is below each of the active portions and inside the manifold plates 36 and 35. As shown in FIG. 5B, a common ink chamber 35*a* which accommodates (contains) the black ink is formed at a position which is below the active portion 41 and inside the manifold plates 36 and 35; and a common ink chamber 35*b* which accommodates (contains) the yellow ink is formed at a position which is below the active portion 42 and inside the manifold plates 36 and 35. Common ink chambers, which accommodate the cyan ink and the magenta ink respectively, have a same volume as a volume of the common ink chamber 35*b* for the yellow ink. The common ink chamber 35*a* which accommodates the black ink is formed to have a volume greater than a volume of the common ink chambers each of which accommodate an ink of other color than the black ink.

The head holder 9 includes a relay tank (not shown in the diagram) having a relay ink chamber which stores an air bubble present in the ink which is supplied from each of the tanks 5*a* to 5*d* (see FIG. 1). The inks are supplied from the ink tanks 5*a* to 5*d* via the relay tank to ink supply ports 30*e*, 30*f*, 30*g*, and 30*h*, respectively (see FIG. 4). The inks supplied to the ink supply ports 30*e* to 30*h* are supplied to the common ink chambers 35*a* to 35*d*, respectively, communicating with the ink supply ports 30*e* to 30*h* respectively.

Apertures (throttles) are formed inside the supply plate 33 which is arranged on an upper side of each common ink chamber. Each of the apertures communicates with one of common ink chambers via a communicating hole formed penetratingly in an up and down direction (vertical direction) in the spacer plate 34 which is arranged between the manifold plate 35 and the supply plate 33. As shown in FIG. 5B, an aperture 33*a* is formed at a position over or above the common ink chamber 35*a* which accommodates the black ink, and the aperture 33*a* communicates with the common ink chamber 35*a* via a communicating hole 34*a*. An aperture 33*b* is formed at a position above the common ink chamber 35*b* which accommodates the yellow ink, and the aperture 33*b* communicates with the common ink chamber 35*b* via a communicating hole 34*b*.

Figure 4:
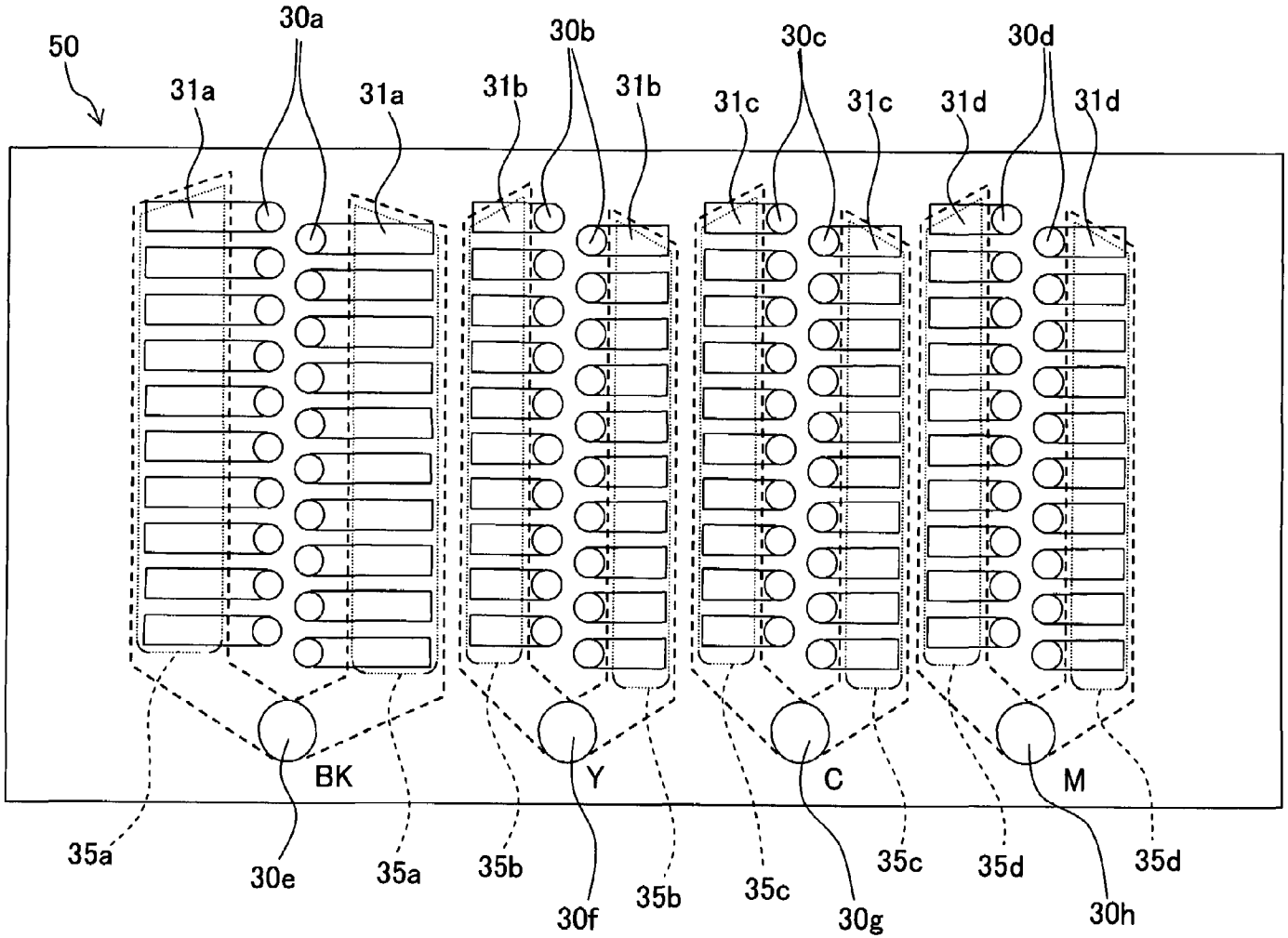
FIG. 4 is a plan view showing a cavity unit which constructs the head unit in FIG. 3.

Each of the pressure chambers is formed, inside the cavity plate 31 which is arranged at a position above of the apertures, at a position facing the lower surface of one of the active portions. As shown in FIG. 4, when a surface of the cavity plate 31 is viewed from above, the respective pressure chambers are arranged corresponding to the arrangement of the nozzles. In this embodiment, the pressure chambers are arranged in two rows for each of the inks; and the pressure chambers, in the two pressure-chamber rows for each of the inks, are arranged in a zigzag or staggered form. Further, each of the pressure chambers is extended in a direction orthogonal to a direction of arrangement in which the nozzles are arranged (nozzle-arrangement direction) A length and a width of each of the pressure chambers is slightly greater than the length L1, L2, and the width D1 of one of the active portions 41, 42, 43, and 44 corresponding thereto. Consequently, a group of pressure chambers 31*a* (first pressure chamber group) for the black ink are longer than a group of pressure chambers 31*b*, 31*c*, and 31*d* (second pressure chamber group) for the inks of other three colors respectively; but the width is same among the pressure chambers 31*a* to 31*d*. The length is same among the pressure chambers 31*b*, 31*c*, and 31*d* for the other colors respectively. Note that in FIG. 4, the pressure chambers are illustrated in which its number is partially omitted, and that the actual number of the pressure chambers included in each of the pressure-chamber rows is greater than the number of pressure chambers shown in FIG. 4, and the actual number may be, for example, 64.

Each of the pressure chambers communicates with one of the apertures via a communicating hole which is formed penetratingly in a vertical direction in the base plate 32 which is arranged between the supply plate 33 and the cavity plate 31. As shown in FIG. 5B, the pressure chamber 31*a* which accommodates the black ink is formed at a position at which the pressure chamber 31*a* faces the lower surface of the active portion 41, and which is above the aperture 33*a* through which the black ink flows. The pressure chamber 31*a* communicates with the aperture 33*a* via a communicating hole 32*a*. The pressure chamber 31*b* which accommodates the yellow ink is formed at a position at which the pressure chamber 31*b* faces the lower surface of the active portion 42, and which is above the aperture 33*b* through which the yellow ink flows. The pressure chamber 31*b* communicates with the aperture 33*b* via a communicating hole 32*b*.

Since a cross-sectional area in a vertical direction of each apertures is smaller than a cross-sectional area in the vertical direction of one of the pressure chambers with which the aperture communicates, each of the apertures has a channel resistance greater than a channel resistance of one of the pressure chambers communicating with the aperture. In other words, each of the apertures functions to alleviate or absorb a pressure fluctuation, generated in one of the pressure chambers communicating with the aperture, from reaching the common ink chamber.

Damper chambers are formed in the lower surface of the damper plate 37, each at a position below one of the common ink chambers. Each of the damper chambers is formed to be open downwardly in the lower surface of the damper plate 37. Each of the damper chambers is formed to have a horizontal cross-sectional shape which is same, in a plan view, as a horizontal cross-sectional shape of one of the common ink chambers adjacent to the damper plate 37. As shown in FIG. 5B, a damper chamber 37*a* is formed at a position below the common ink chamber 35*a* for the black ink, and a damper chamber 37*b* is formed at a position below the common ink chamber 35*b* for the yellow ink.

The damper plate 37 is formed of a material such as a metal which is elastically deformable. A bottom plate portion, in the form of a thin plate, in the upper portion of the damper chamber is capable of vibrating freely toward the common ink chamber and toward the damper chamber. Upon jetting the ink, the damper plate 37 is deformed elastically at the bottom plate portion thereof so as to vibrate, thereby absorbing and attenuating the pressure wave even when the pressure fluctuation generated in a certain pressure chamber is propagated to the common ink chamber, and thus preventing a cross-talk in which the pressure fluctuation in the certain pressure chamber is propagated to another pressure chamber.

Through holes, which are mutually communicated and which guide the ink in each of the pressure chambers to one of the nozzles are formed, penetratingly in a vertical direction, in the plates 32 to 38, respectively, which are arranged between the cavity plate 31 and the nozzle plate 39. Hereinafter, an ink channel formed by these through holes is referred to as "descender". As shown in FIG. 5B, a descender 30*a* is formed in the cavity unit 50 penetratingly in a portion thereof in the vertical direction between the pressure chamber 31*a* and a nozzle 39*a* which jets the black ink in the pressure chamber 31*a*. A descender 30*b* is formed in the cavity unit 50 penetratingly in a portion thereof in the vertical direction between the pressure chamber 31*b* and a nozzle 39*b* which jets the yellow ink in the pressure chamber 31*b*.

The nozzle 39*a* which jets the black ink is formed to have a diameter $\phi$1 greater than a diameter $\phi$2 of the nozzles 39*b* to 39*d* which jet the color inks other than the black ink. Consequently, it is possible to jet, at a nearly same speed, a droplet of the black ink and a droplet of the color ink to which varying energies are imparted respectively. Accordingly, it is possible to make the ink droplet (liquid droplet) land at a desired position, and to perform the recording with a high quality. Further, since it is possible to reduce a volume of a droplet of the dye ink, it is possible to realize a high-quality recording by the dye ink. In this embodiment, the diameter $\phi$1 of the nozzle 39*a* which jets the black ink is 20 μm, and the diameter $\phi$2 of each of the nozzles 39*b* to 39*d* is 17 μm. Furthermore, in this embodiment, a maximum amount of the volume of the liquid droplet of ink which can be jetted from the nozzle when one driving signal is applied to the active portion is 24 pl (pico liters) for the black ink, and 16 pl for the color inks other than the black ink. However, these amounts of volume are merely examples, and are not intended to limit the volumes to these amounts. Although the appropriate values change depending on the components (surfactant and the like) contained in the inks, viscosity of the inks, kind of paper onto which the recording is performed, or the like, it is desired to generally set a ratio of the volume of the liquid droplet of black ink and the volume of the liquid droplet of color ink within a range of 3:2 to 2:1 with respect to the inks and recording papers (regular papers) which are actually used in many cases.

Further, as described above, the active portion 41 of the black ink generates energy greater than the energy generated by each of the other active portions 42, 43, and 44. Furthermore, since the pressure chamber 31*a* of the black ink has a volume greater than that of the pressure chambers 31*b*, 31*c*, and 31*d* of the other inks, it is possible to make the volume of a droplet of the black ink jetted from the nozzle 39*a* to be greater than the volume of droplets of the yellow ink, the cyan ink, and the magenta ink which are jetted from the nozzles 39*b*, 39*c*, and 39*d* respectively.

Figure 6:
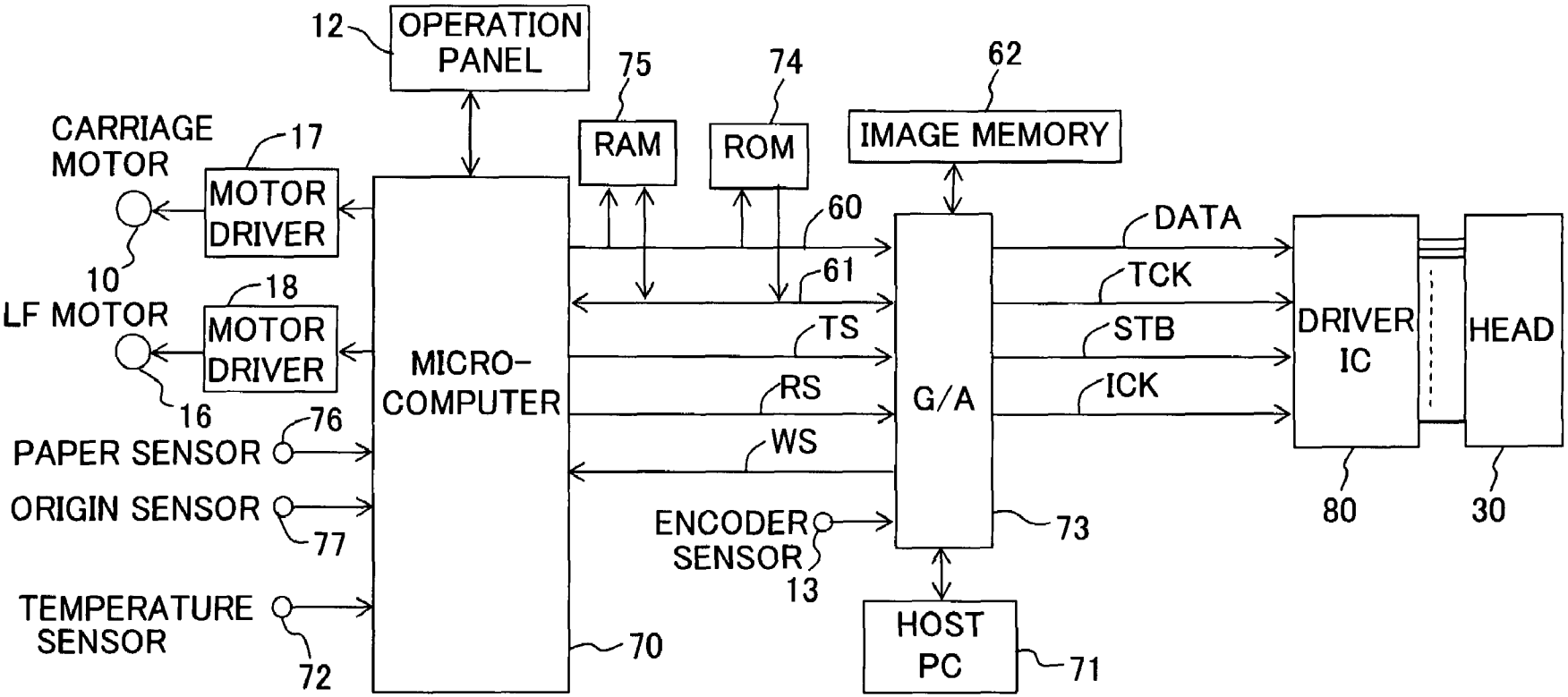
FIG. 6 is a block diagram of a main structure of a control system of the ink-jet recording apparatus shown in FIG. 1.

Next, a main structure of a control system of the ink-jet recording apparatus 1 will be explained below by referring to a block diagram in FIG. 6. The ink-jet recording apparatus 1 includes a microcomputer 70, a ROM (read only memory) 74, and a RAM (random access memory) 75. An operation panel 12 via which the user gives instruction or the like, a motor driver 17 which drives the carriage motor 10, a motor driver 18 which drives a LF motor 16, a paper sensor 76 which detects a leading end of the recording paper P, an origin sensor 77 which detects an origin position of the head holder 9, and a temperature sensor 72 which detects a temperature of the head unit 30 are connected to the microcomputer 70. The ink-jet printer 1 is constructed such that when the temperature detected by the temperature sensor 72 is changed (fluctuated), a drive voltage which drives the head unit 30 is changed, thereby preventing any deterioration of the recording quality which would be otherwise caused accompanying with a change in a viscosity of the ink due to the change in the temperature.

The head unit 30 is driven by a driver IC 80, and the driver IC 80 is controlled by a gate array (G/A) 73. Each of the electrodes, provided to the head unit 30 and forming one of the active portions, is connected to the driver IC 80. The driver IC 80 generates, based on the control of the gate array 73, a driving signal suitable for each of the active portions, and applies the driving signal to each of the electrodes.

The microcomputer 70, the ROM 74, the RAM 75 and the gate array 73 are connected to each other via an address bus 60 and a data bus 61. The microcomputer 70 generates a recording timing signal TS and a control signal RS according to a program pre-stored in the ROM 74, and transfers or transmits the signals TS, RS to the gate array 73. In accordance with the recording timing signal TS and the control signal RS and based on recording data stored in an image memory 62, the gate array 73 generates transfer data signal DATA for recording the recording data onto the paper P, a transfer clock TCK which is synchronized with the transfer data signal DATA, a strobe signal STB, and a recording clock ICK, and the gate array 73 transmits these signals DATA, TCK, STB, ICK to the driving IC 80.

Further, the gate array 73 makes the image memory 62 store therein recording data transmitted from an external apparatus such as a host computer (host PC) 71. Based on the data transmitted from the host computer 71 or the like, the gate array 73 generates a data reception/interruption signal WS and transmits the generated signal WS to the microcomputer 70. Further, an encoder sensor 13, which detects a running position of the head holder 9, is connected to the gate array 73.

Figure 7:
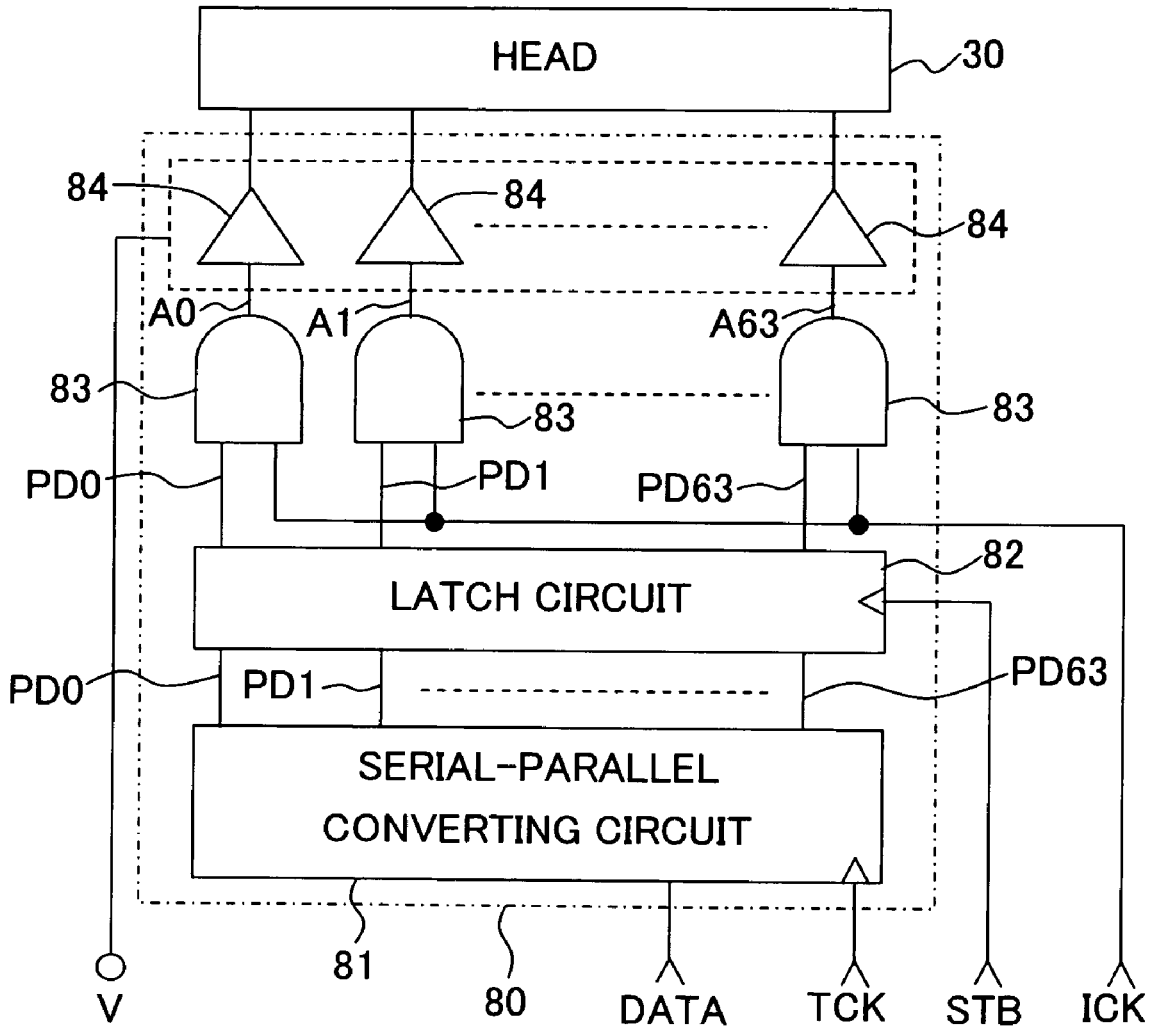
FIG. 7 is a block diagram showing a main structure of a driver IC 80.

Next, a main structure of the driver IC 80 will be explained below by referring to FIGS. 7 and 8. Here, the explanation is made by taking an example of the driver IC 80, in a case of driving a 64 channel-multi nozzle head in which 64 pieces of the nozzles are included in a nozzle row for each of the inks.

The driver IC 80 includes a serial-parallel converting circuit 81, a latch circuit 82, an AND gate 83, and an output circuit 84. The serial-parallel converting circuit 81 is formed by a 64-bit shift register. The serial-parallel converting circuit 81 inputs a transfer data signal DATA which is serial-transferred by being synchronized with the transfer clock TCK; and the serial-parallel converting circuit 81 converts the transfer data signal DATA to parallel data PD0 to PD63, respectively, in accordance with rising of the transfer clock TCK. In other word, the serial-parallel converting circuit 81 performs a serial-parallel conversion of the transfer data signal DATA.

The latch circuit 82 latches each of the parallel data PD0 to PD63, in accordance with rising of the strobe signal STB transferred from the gate array 73. 64 pieces of AND gates 83 take a logical product of each of the parallel data PD0 to PD63 outputted from the latch circuit 82 and the printing (recording) clock ICK transferred from the gate array 73; and the latch circuit 82 generates drive data A0 to A63 as a result of a logical product of the parallel data PD0 to PD63 respectively.

Figure 8A:
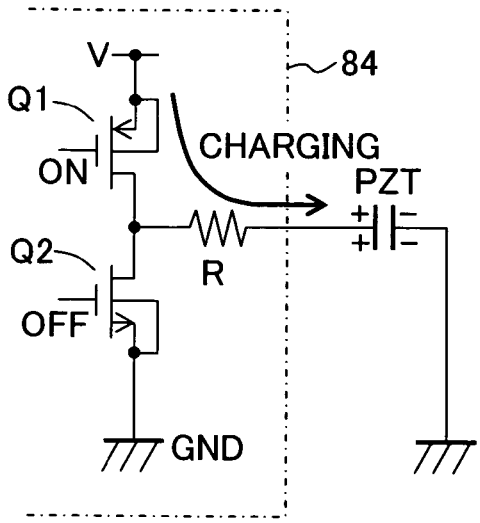
FIG. 8A is a view for explaining a case in which a portion of the active portion which is made of a piezoelectric material is replaced by a condenser in a circuit diagram of an output circuit shown in FIG. 7, and in a charging state.
Figure 8B:
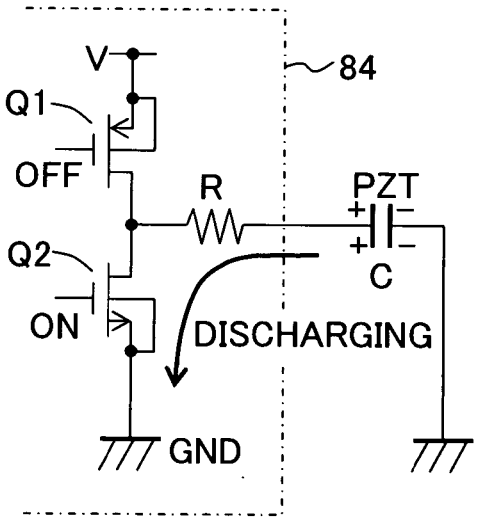
FIG. 8B is a view for explaining a discharging state.

A condenser C, which is connected to an output side of the output circuit 84 in FIGS. 8A and 8B, is a condenser which functions as an equivalent circuit of a portion, of the active portion, made of the piezoelectric material. Further, a resistance R in the output circuit 84 is an internal resistance of the output circuit 84. The output circuit 84 includes an N-type power MOSFET Q1 and a P-type power MOSFET Q2, and a drive voltage V is applied to a source terminal of the power MOSFET Q1. A drain terminal of the power MOSFET Q1 is connected to the condenser C via the resistance R, together with a drain terminal of the power MOSFET Q2. An output of the AND gate 83 is applied to the gate terminal of each of the power MOSFET Q1 and the power MOSFET Q2.

As shown in FIG. 8A, a current flows from the AND gate 83 to the gate terminal of the power MOSFET Q1, and turns the power MOSFET Q1 to "ON" and the power MOSFET Q2 is turned "OFF", which in turn causes the current flow between the source and the drain of the power MOSFET Q1, thereby charging the condenser C. As a result, the active portion is displaced or deformed downwardly, and the volume of the pressure chamber is decreased. Further, as shown in FIG. 8B, when the power MOSFET Q1 is turned "OFF" and the power MOSFET Q2 is turned "ON", then the current flows between the drain and the source of the power MOSFET Q2, thereby discharging the condenser C. As a result, the active portion returns to a state before the deformation, thereby increasing the volume of the pressure chamber to generate a pressure wave in the pressure chamber. When the power MOSFET Q1 is turned "ON" again substantially concurrently with a timing at which the pressure is increased in a variable period (period of fluctuation) of the pressure wave, so as to decrease the volume of the pressure chamber, then a pressure of the pressure wave and a pressure due to the deformation of the active portion are overlapped (superimposed), thereby jetting the ink in the pressure chamber from the nozzle via the descender. In other words, in a normal state, the pressure chamber is contracted (or the volume of the pressure chamber is reduced) due to the output from the AND gate 83, and by turning the output "ON" after the output was turned "OFF", the ink is jetted due to a so-called pulling ejection action. Alternatively, it is also allowable that in the normal state, the active portion is not displaced, and the ink is jetted by a pushing ejection in which the volume of the pressure chamber is decreased by turning the voltage "ON".

Figure 8C:
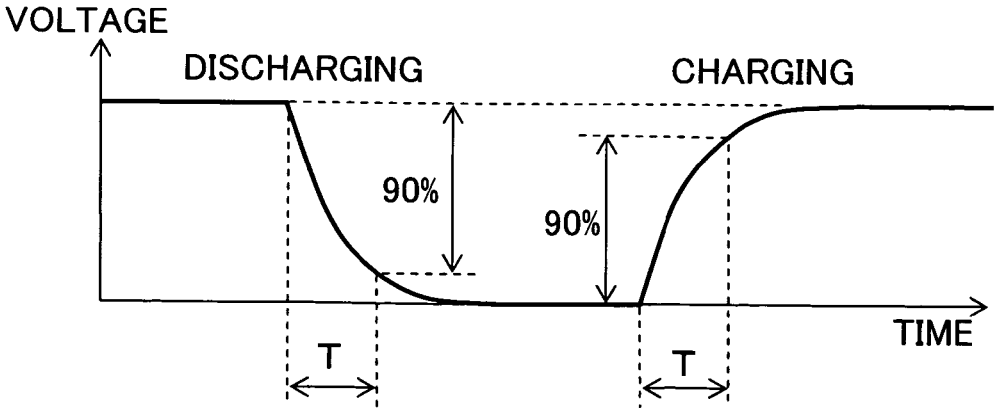
FIG. 8C is a view showing a waveform of a driving signal applied to the active portion.

Here, a driving waveform to be applied to the electrodes of the active portions 41 to 44 is made to be a driving waveform which has charge and discharge characteristics of the condenser C as shown in FIG. 8C. Further, when a time required for a charging voltage to reach 90% from a start of charging the condenser C is designated as a rising time T of the driving waveform, and a time required for the charging voltage to reach −90% from a start of discharging the condenser C from a fully charged state is designated as a falling time T of the driving waveform, then a relationship indicated by the following expression 1 is established among the rising time and falling time T, a capacitance C of the condenser, and the internal resistance R:

$$T=-In(0.1)CR \qquad \text{expression 1}$$

Figure 9A:
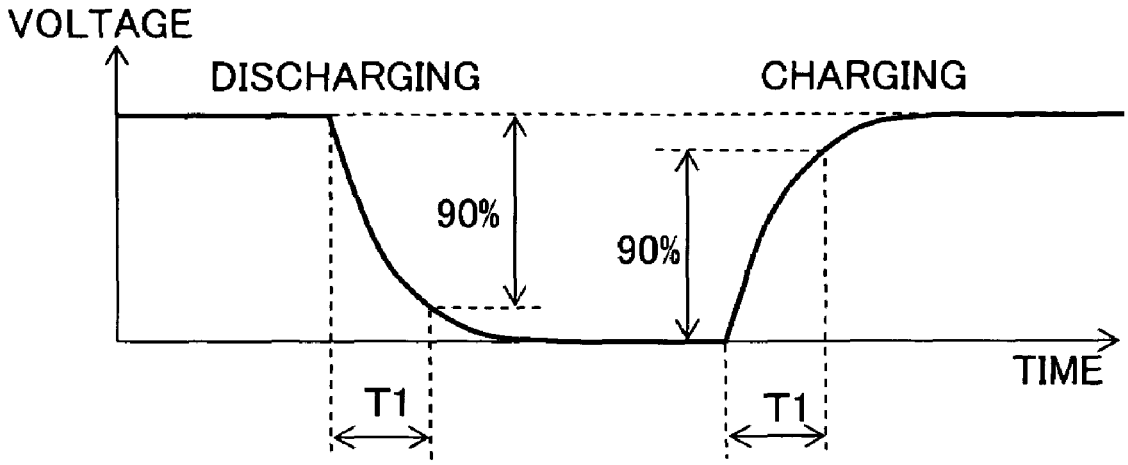
FIG. 9A is a timing chart showing a driving waveform applied to an active portion which jets a black ink.
Figure 9B:
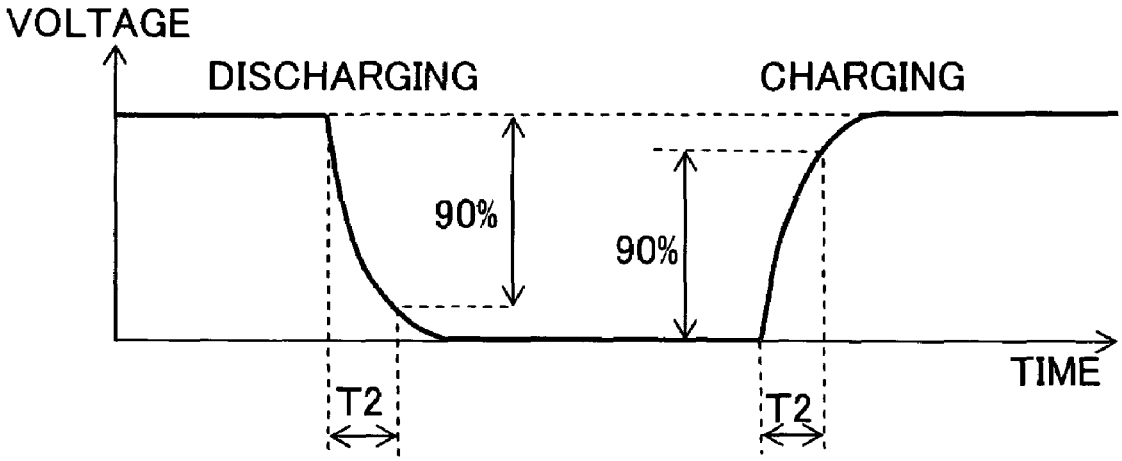
FIG. 9B is a timing chart showing a driving waveform applied to an active portion which jets a color ink.

Here, in this embodiment, as shown in FIGS. 9A and 9B, a rising time and a falling time T1 of the driving waveform applied to the active portion 41 for jetting the black ink are set to be longer than a rising time and a falling time T2 of the driving waveform applied to each of the active portions 42 to 44 for jetting the color inks respectively. Generally, when a length of the rising time or the falling time of the driving waveform is made to be longer, the volume of the droplet of ink is increased. Consequently, in the case of black ink, ink droplets having a large volume can be obtained; and in the case of color ink, ink droplets having a small volume can be obtained. Accordingly, it is possible to increase the recording speed with the black ink, and to realize a high-quality recording with the color ink. Furthermore, in the ink-jet recording apparatus 1 of this embodiment, a relationship indicated by the following expression 2 is established:

$$C1/C2=T1/T2 \qquad \text{expression 2}$$

In other words, since the internal resistance R in the output circuits 84 for driving the active portions respectively have a same value, the driver IC 80 can be designed easily. Consequently, a quality control of the driver IC 80 does not become complicated, and thus it is possible to reduce the manufacturing cost of the ink-jet recording apparatus 1. In this embodiment, T1=1.5 μs and T2=1.0 μs. As described above, since C1=1500 pF and C2=1000 pF, C1/C2=1500/1000=1.5; and since T1/T2=1.5/1.0=1.5, therefore C1/C2=T1/T2. In the embodiment, both the rising time and the falling time of the driving waveform for the black ink are longer than the rising time and the falling time of the driving waveform for each of the color inks. However, it is also allowable that only one of the rising time and the falling time is longer than one of the rising time and the falling time of the driving waveform for each of the color inks.

In this embodiment, the area S2 of each of the active portions 42 to 44, and dimensions of ink channels such as the pressure chambers, apertures, and the common ink chambers corresponding to the active portions 42 to 44 are smaller than the area S1 and the area of ink channel such as the pressure chamber, aperture, and the common ink chamber corresponding to the active portion 41. Accordingly, it is possible to minitualize the head unit than a head unit in which the area of the active portions and the volume of the ink channels are formed to be same irrespective of the type of the ink. Further, it is possible to shorten a variation period (fluctuation period) of the pressure wave in the pressure chamber, by reducing the dimensions of the ink channels. Consequently, it is possible to increase a frequency of the driving frequency and thus to increase the recording speed.

The present invention has been explained specifically as above. However, the present invention is not limited to the above description, and it is possible to make various modifications and changes within a scope of the claims. For example, the present invention is also applicable to an ink-jet recording apparatus in which the black ink is a pigment ink and at least one of the color inks other than the black ink is a pigment ink. In this case also, it is possible to achieve effects same as in the embodiment described above. Further, the length D1 of the active portion in the short direction may be different in the active portion for jetting the pigment ink and the active portion for jetting the dye ink.

It is allowable to adopt a construction in which the number of nozzle rows jetting a specific ink may be different from that of nozzle rows jetting the other inks. For example, it is allowable to provide a plurality of rows of nozzles jetting the black ink, and one nozzle row is provided for jetting each of the color inks other than the black ink. Further, it is possible to have the similar effect by using a MOSFET, an FET, an NPN transistor or a PNP transistor, instead of the power MOSFET.

What is claimed is:

1. An ink-jet recording apparatus which performs recording by jetting a pigment ink and a dye ink, the apparatus comprising:

a first nozzle group which jets the pigment ink;

a second nozzle group which jets the dye ink;

a first pressure chamber group which is provided corresponding to the first nozzle group;

a second pressure chamber group which is provided corresponding to the second nozzle group;

a first active portion group which applies a jetting pressure, to the pigment ink in the first pressure chamber group, by a piezoelectric effect; and a second active portion group which applies the jetting pressure, to the dye ink in the second pressure chamber group, by the piezoelectric effect;

wherein a diameter of nozzles belonging to the first nozzle group is greater than a diameter of nozzles belonging to the second nozzle group;

an active portion, belonging to the first active portion group, which faces a pressure chamber belonging to the first pressure chamber group has an area greater than an area of an active portion, belonging to the second active portion group, which faces a pressure chamber belonging to the second pressure chamber group.

2. The ink-jet recording apparatus according to claim 1, wherein the diameter of the nozzles belonging to the first nozzle group is 20 μm; and the diameter of the nozzles belonging to the second nozzle group is 17 μm.

3. The ink-jet recording apparatus according to claim 1, wherein an electrostatic capacitance of the active portion belonging to the first active portion group is greater than an electrostatic capacitance of the active portion belonging to the second active portion group.

4. The ink-jet recording apparatus according to claim 3, wherein the electrostatic capacitance of the active portion belonging to the first active portion group is 1500 pF; and the electrostatic capacitance of the active portion belonging to the second active portion group is 1000 pF.

5. The ink-jet recording apparatus according to claim 1, wherein one of a rising time and a falling time of a driving waveform for generating the piezoelectric effect in the active portion belonging to the first active portion group is longer than one of a rising time and a falling time of a driving waveform for generating the piezoelectric effect in the active portion belonging to the second active portion group.

6. The ink-jet recording apparatus according to claim 5, wherein one of the rising time and the falling time of the driving waveform for generating the piezoelectric effect in the active portion belonging to the first active portion group is 1.5 μs; and one of the rising time and the falling time of the driving waveform for generating the piezoelectric effect in the active portion belonging to the second active portion group is 1.0 μs.

7. The ink-jet recording apparatus according to claim 1, wherein the diameter of the nozzles belonging to the first nozzle group and the diameter of the nozzles belonging to the second nozzle group are selected so that a jetting speed of the pigment ink is same as a jetting speed of the dye ink.

8. The ink-jet recording apparatus according to claim 1, wherein the pigment ink is a black ink, and the dye ink is a color ink.

9. An ink-jet recording apparatus which performs recording by jetting a pigment ink and a dye ink, the apparatus comprising:

a first nozzle group which jets the pigment ink;

a second nozzle group which jets the dye ink;

a first pressure chamber group which is provided corresponding to the first nozzle group;

a second pressure chamber group which is provided corresponding to the second nozzle group;

a first active portion group which applies a jetting pressure, to the pigment ink in the first pressure chamber group, by a piezoelectric effect; and a second active portion group which applies the jetting pressure, to the dye ink in the second pressure chamber group, by the piezoelectric effect;

wherein a diameter of nozzles belonging to the first nozzle group is greater than a diameter of nozzles belonging to the second nozzle group;

an active portion, belonging to the first active portion group, which faces a pressure chamber belonging to the first pressure chamber group has an area greater than an area of an active portion, belonging to the second active portion group, which faces a pressure chamber belonging to the second pressure chamber group;

one of a rising time and a falling time of a driving waveform for generating the piezoelectric effect in the active portion belonging to the first active portion group is longer than one of a rising time and a falling time of a driving waveform for generating the piezoelectric effect in the active portion belonging to the second active portion group; and a ratio of an electrostatic capacitance of the active portion belonging to the first active portion group to an electrostatic capacitance of the active portion belonging to the second active portion group is same as a ratio of one of the rising time and the falling time of the driving waveform for generating the piezoelectric effect in the active portion belonging to the first active portion group to one of the rising time and the falling time of the driving waveform for generating the piezoelectric effect in the active portion belonging to the second active portion group.

10. The ink-jet recording apparatus according to claim 9, wherein the diameter of the nozzles belonging to the first nozzle group is 20 μm; and the diameter of the nozzles belonging to the second nozzle group is 17 μm.

11. The ink-jet recording apparatus according to claim 9, wherein one of the rising time and the falling time of the driving waveform for generating the piezoelectric effect in the active portion belonging to the first active portion group is 1.5 μs; and one of the rising time and the falling time of the driving waveform for generating the piezoelectric effect in the active portion belonging to the second active portion group is 1.0 μs.

12. The ink-jet recording apparatus according to claim 9, wherein a ratio of an electrostatic capacitance of the active portion belonging to the first active portion group to an electrostatic capacitance of the active portion belonging to the second active portion group is 1.5.

13. The ink-jet recording apparatus according to claim 9, wherein the diameter of the nozzles belonging to the first nozzle group and the diameter of the nozzles belonging to the second nozzle group are selected so that a jetting speed of the pigment ink is same as a jetting speed of the dye ink.

14. The ink-jet recording apparatus according to claim 9, wherein a circuit resistance of an output circuit which drives the active portion belonging to the first active portion group is same as a circuit resistance of an output circuit which drives the active portion belonging to the second active portion group.

15. The ink-jet recording apparatus according to claim 9, wherein the pigment ink is a black ink, and the dye ink is a color ink.

* * * * *